US010094175B2

(12) United States Patent
Mason et al.

(10) Patent No.: US 10,094,175 B2
(45) Date of Patent: Oct. 9, 2018

(54) TORQUE TRACK SYSTEM

(71) Applicant: Nabors Drilling Technologies USA, Inc., Houston, TX (US)

(72) Inventors: Aaron Edward Mason, Chestermere (CA); Douglas Christian Greening, Calgary (CA)

(73) Assignee: Nabors Drilling Technologies USA, Inc., Houston, TX (US)

( * ) Notice: Subject to any disclaimer, the term of this patent is extended or adjusted under 35 U.S.C. 154(b) by 69 days.

(21) Appl. No.: 15/164,692

(22) Filed: May 25, 2016

(65) Prior Publication Data

US 2017/0342780 A1 Nov. 30, 2017

(51) Int. Cl.
*E21B 15/00* (2006.01)
*E21B 3/02* (2006.01)

(52) U.S. Cl.
CPC ..... *E21B 15/00* (2013.01); *E21B 3/02* (2013.01)

(58) Field of Classification Search
CPC ..... E21B 15/00; E21B 19/16; E21B 21/02; E21B 3/02
See application file for complete search history.

(56) References Cited

U.S. PATENT DOCUMENTS 4,021,978 A 5/1977 Busse et al.
5,092,411 A 3/1992 Hausherr et al.
5,107,940 A 4/1992 Berry
5,190,337 A * 3/1993 McDaniel ..... B60P 3/42 224/405
5,381,867 A 1/1995 Berry
6,024,181 A 2/2000 Richardson et al.
9,140,076 B2 9/2015 Mahoney et al.
2003/0086752 A1* 5/2003 LeMole ..... B60J 7/1204 403/102
2008/0308319 A1 12/2008 Zhang
2013/0145723 A1* 6/2013 Mahoney ..... E21B 15/00 52/848

FOREIGN PATENT DOCUMENTS

WO 2017091495 6/2017

OTHER PUBLICATIONS

International Search Report and Written Opinion for International Application No. PCT/US2012/066848 dated Oct. 2, 2013.
PCT/US2017/034299 International Search Report and Written Opinion dated Aug. 22, 2017.

* cited by examiner

*Primary Examiner* — Caroline N Butcher
(74) *Attorney, Agent, or Firm* — Enrique Abarca; Abel Law Group, LLP

(57) ABSTRACT

A drilling rig includes a torque track system configured to couple to a derrick and to a top drive of the drilling rig, where the torque track system is configured to resist movement of the top drive in a lateral direction with respect to the derrick and to transfer torsional loads to the derrick in an operating configuration, a first torque track segment of the torque track system, and a second torque track segment of the torque track system coupled to the first torque track segment with a joint. The joint is configured to enable the first torque track segment and the second torque track segment to pivot with respect to one another while maintaining a physical connection between the first torque track segment and the second torque track segment during manipulation of the torque track system into and out of the operating configuration.

16 Claims, 11 Drawing Sheets

TORQUE TRACK SYSTEM

BACKGROUND

The present disclosure relates generally to the field of drilling and processing of wells, and, more particularly, to a torque track system and method for assembling the torque track system.

In conventional oil and gas operations, a well is typically drilled to a desired depth with a drill string, which may include drillpipe, drill collars, and a bottom hole drilling assembly. The drill string may be turned by a rotary table and kelly assembly or by a top drive. A top drive typically includes a quill, which is a short length of pipe that couples with the upper end of the drill string, and one or more motors configured to turn the quill. The top drive is typically suspended from a traveling block above the rig floor so that it may be raised and lowered throughout drilling operations.

The top drive is attached to a torque track system that extends from a bottom portion to a top portion of the derrick. The torque track system guides the top drive as it moves between the bottom and the top of the derrick, restrains the top drive from lateral movement, and transfers torsional loads from a drilling operation to the derrick. Assembling and disassembling a torque track system may present various challenges. Additionally, torque track systems may be bulky and/or difficult to transport to and from the well location. Traditionally, multiple elongate track segments are assembled to form the torque track system. During disassembly, the multiple track segments are completely disconnected from one another (e.g., no physical connection between track segments). In certain configurations, the elongate track segments may be held together using pins or bolts. A technician that drives the pins into the track segments, or removes the pins from the track segments, may be suspended in the air along various vertical positions of the drilling rig to drive or remove the pins as individual torque track segments are carried toward the technician (e.g., via a crane). As may be appreciated, assembling or disassembling a torque track system in such a manner may be time consuming and difficult to perform. Accordingly, it may be desirable to provide an enhanced torque track system.

BRIEF DESCRIPTION

In accordance with one aspect of the present disclosure, a drilling rig includes a torque track system configured to couple to a derrick and to a top drive of the drilling rig, where the torque track system is configured to resist movement of the top drive in a lateral direction with respect to the derrick and to transfer torsional loads to the derrick in an operating configuration, a first torque track segment of the torque track system, and a second torque track segment of the torque track system coupled to the first torque track segment with a joint. The joint is configured to enable the first torque track segment and the second torque track segment to pivot with respect to one another while maintaining a physical connection between the first torque track segment and the second torque track segment during manipulation of the torque track system into and out of the operating configuration.

In accordance with another aspect of the present disclosure, a torque track system includes a plurality of torque track segments, where a first end torque track segment of the plurality of torque track segments couples the torque track system to a first end of a drilling rig, and where a second end torque track segment of the plurality of torque track segments couples the torque track system to a second end of the drilling rig, and a plurality of joints configured to couple the plurality of torque track segments to one another, where each joint of the plurality of joints include a connector and one or more knuckles secured to the connector by a fastener of a plurality of fasteners, and where the one or more knuckles are configured to rotate within grooves of the connector such that each torque track segment of the plurality of torque track segments pivots relative to one another from an operating configuration to a stacked configuration.

In accordance with another aspect of the present disclosure, a method includes aligning a first torque track segment with a second torque track segment, such that the first and second torque track segments extend in a direction generally parallel to a direction of movement of a top drive of a drilling rig and resisting rotation of the first torque track segment with respect to the second torque track segment by disposing a fastener into an opening of a rotatable joint coupling the first torque track segment to the second torque track segment when assembling the drilling rig.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

The present disclosure provides an improved top drive torque track system and methods for manipulating the top drive torque track system. As used herein, the term "manipulating" may refer to assembling, disassembling, or both. The presently disclosed techniques enable segments of a torque track system to fold (e.g., stack) on top of one another to facilitate manipulation of the torque track system and to reduce a compacted or disassembled size of the torque track system, thereby facilitating transportation of the torque track system. As such, in one embodiment, segments of the torque track system may be coupled to one another with a rotatable joint. The rotatable joint may include one or more fasteners that are configured to both lock adjacent segments in place and to enable rotation of two adjacent segments with respect to one another. Further, the fasteners may maintain a physical connection between torque track segments of the torque track system when the torque track system is disassembled (e.g., in a stacked position or configuration). As used herein, a physical connection may relate to adjacent torque track segments that are mechanically coupled to one another via a fastener or other suitable securement device. Accordingly, the torque track system disclosed herein may remain partially assembled when in a stacked position (e.g., stacked configuration). Thus, a technician manipulating the torque track system may not completely connect and/or disconnect each torque track segment from one another, thereby reducing an amount of time for manipulating the torque track system. Accordingly, embodiments of the present disclosure may improve efficiency of manipulating a drilling rig, as well as reduce costs associated with manipulating the drilling rig.

Figure 1:
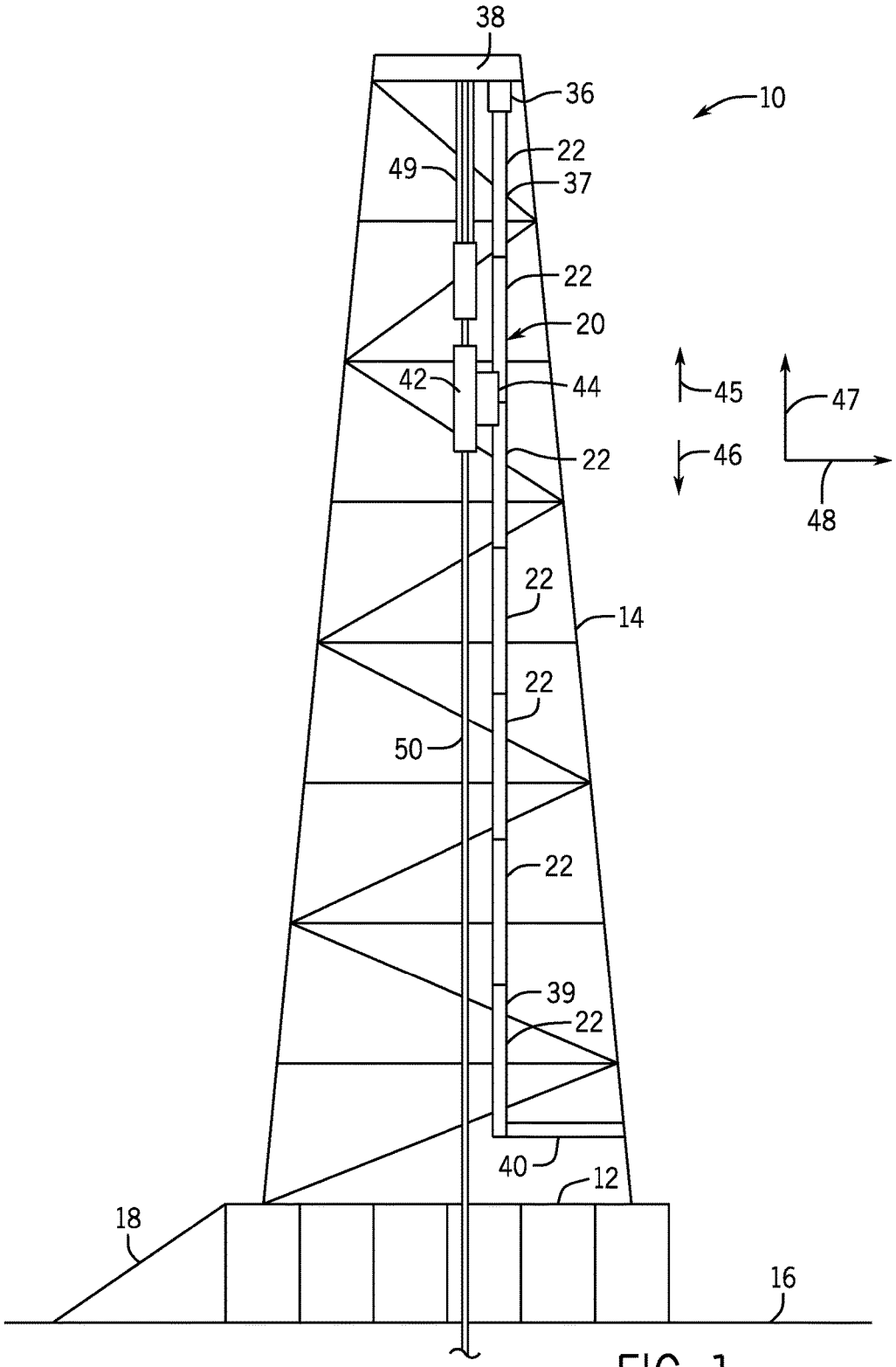
FIG. 1 is a schematic of a drilling rig that includes a torque track system, in accordance with an aspect of the present disclosure.

Turning now to the drawings, FIG. 1 is a schematic of a drilling rig 10 in the process of drilling a well. The drilling rig 10 features an elevated rig floor 12 and a derrick 14 extending above the rig floor 12. The elevated rig floor 12 is positioned above ground 16. As illustrated, a pipe ramp 18 extends from the ground 16 to the elevated rig floor 12 and may be used to aid in moving pipe from the ground 16 to the rig floor 12. A torque track system 20 extends from a bottom portion of the derrick 14 to a top portion of the derrick 14. The torque track system 20 is used to transfer torsional loads from a drilling operation to the derrick 14. The torque track system 20 includes multiple elongate torque track segments 22. In certain embodiments, one or more of the elongate torque track segments 22 include rotatable joints on both distal ends. As will be appreciated, the torque track system 20 may include any number of elongate torque track segments 22, and such torque track segments 22 may vary in length in relation to each other. Further, it should be noted that the derrick 14 may vary in height resulting in torque track systems 20 that vary in length.

To attach the torque track system 20 to the derrick 14, an adjustable hanging cluster 36 is coupled to a first end elongate torque track segment 37. The hanging cluster 36 is attached to a crown beam 38 (e.g., using a pad eye welded to the crown beam 38). A second end elongate torque track segment 39 positioned at the bottom of the derrick 14 (e.g., a T-bar connector) is secured to the derrick 14 by fastening the torque track segment 39 to a T-bar 40. The T-bar 40 is fastened directly to the derrick 14 (e.g., such as by fastening the T-bar 40 to a torque anchor beam located at the bottom portion of the derrick 14). As will be appreciated, in other embodiments, the torque track system 20 may be coupled to the derrick 14 in other ways.

In some embodiments, a top drive 42 is coupled to the torque track system 20 by a carriage assembly 44, which may be considered a component of the top drive 42. The carriage assembly 44 guides the top drive 42 along the torque track system 20 as the top drive 42 moves in a first direction 45 and/or a second direction 46 along a vertical axis 47 between the bottom and the top of the derrick 14. As shown in the illustrated embodiment, the torque track system 20 generally extends along the vertical axis 47, such that the torque track system 20 may block (e.g., resist) lateral movement of the top drive 42 along a horizontal axis 48. Additionally, the torque track system 20 may transfer torsional loads incurred during drilling operations to the derrick 14, thereby reducing wear on the top drive 42. The top drive 42 may be suspended by a cable arrangement 49 which may be looped around the crown beam 38, or otherwise attached to the crown beam 38. Further, a drill string 50 is coupled to the top drive 42. The top drive 42 is used to rotate, raise, and lower the drill string 50, among other things. The drill string 50 passes through the elevated rig floor 12 into the ground 16 (e.g., into a wellbore).

It should be noted that the illustration of FIG. 1 is intentionally simplified to focus on the torque track system 20 described in detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

When manipulating the drilling rig 10, the torque track system 20 may present various challenges, such as completely connecting and/or disconnecting each of the elongate torque track segments 22 from one another. Additionally, upon completion of disassembly of the drilling rig 10, each of the elongate torque track segments 22 may be separate pieces to be transported away from the drilling rig 10 site. Accordingly, it is now recognized that an enhanced or improved torque track system 20 is desired to enhance or improve efficiency of manipulating the torque track system 20, as well as to facilitate transportation of the torque track system 20 to and from the drilling rig 10 (e.g., when the torque track system 20 is removed from the derrick 14).

Figure 2:
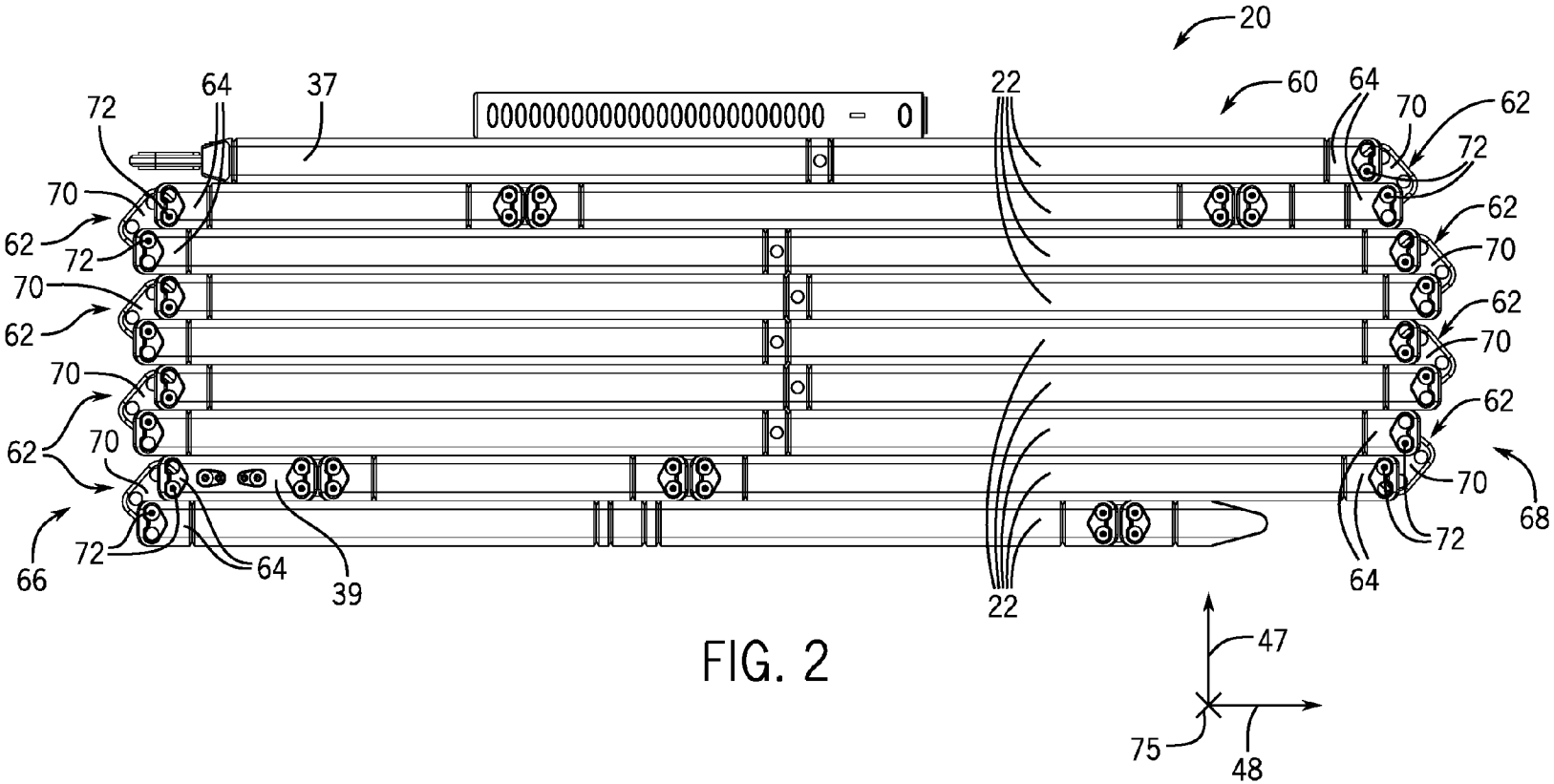
FIG. 2 is an elevation view of an embodiment of the torque track system of FIG. 1 when removed from the drilling rig and in a stacked position, in accordance with an aspect of the present disclosure.

For example, FIG. 2 is an elevation view of the torque track system 20 when disassembled and removed from the drilling rig 10 and in a stacked position 60 (e.g., folded position or stacked configuration). As shown in the illustrated embodiment of FIG. 2, the elongate torque track segments 22 may be folded over one another to form the stacked position 60 (e.g., folded position). The illustrated embodiment of the torque track system 20 includes nine of the torque track segments 22. However, it should be understood that the torque track system 20 may include 1, 2, 3, 4, 5, 6, 7, 8, 10, or more of the torque track segments 22. Indeed, the torque track system 20 may include any suitable number of the torque track segments 22 that enable the torque track system 20 to sufficiently support the top drive 42 by blocking (e.g., resisting) lateral movement of the top drive 42 (e.g., a suitable number of the torque track segments 22 to span a vertical distance of the derrick 14) and/or transferring torsional loads incurred during drilling operations to the derrick 14. In some cases, the torque track system 20 may include the first end torque track segment 37 configured to couple the torque track system 20 to the adjustable hanging cluster 36. Additionally, the torque track system 20 may include the second end torque track segment 39 (e.g., a T-bar connector) configured to couple the torque track system 20 to the T-bar 40. In any case, the torque track segments 22, 37, and/or 39 may be configured to fold over one another into the stacked position 60 while remaining physically coupled to one another.

Figure 3:
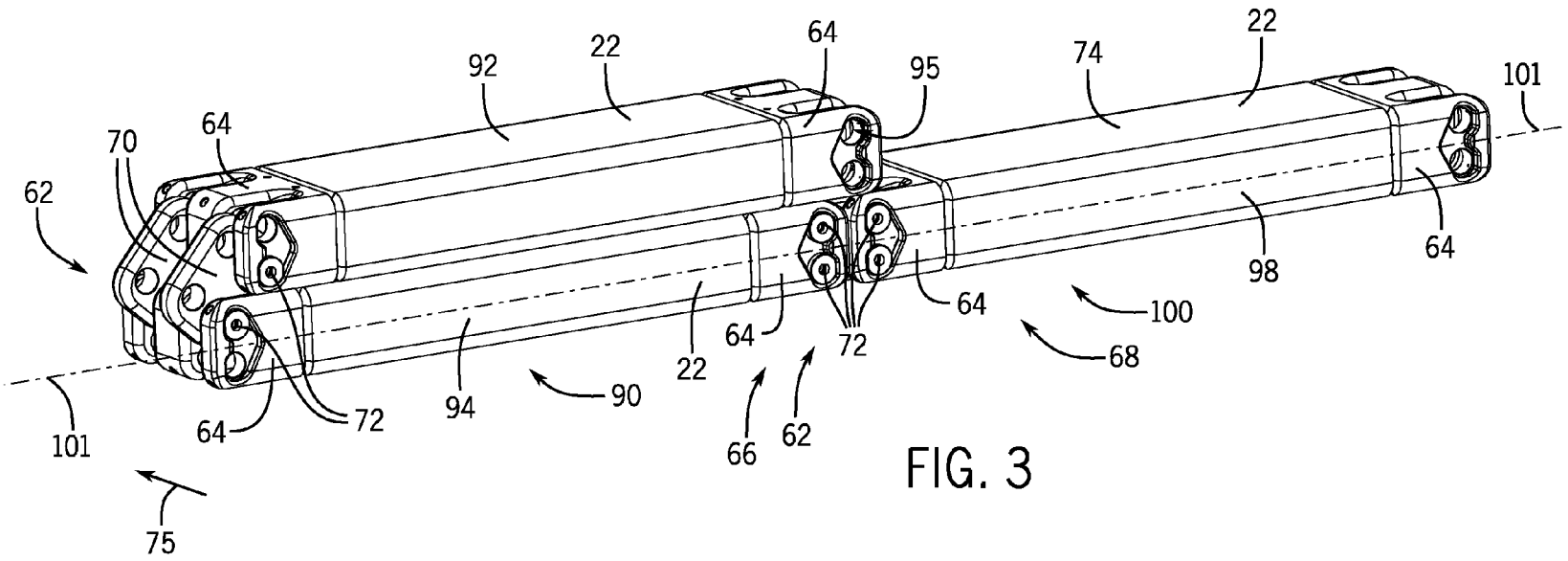
FIG. 3 is a perspective view of an embodiment of a portion of the torque track system of FIG. 1 in a partially stacked position, in accordance with an aspect of the present disclosure.

For example, the torque track segments 22 may be coupled to one another via rotatable joints 62. As shown in the illustrated embodiment, each of the torque track segments 22 may include a connector 64 on a respective first end 66 and a respective second end 68 of each of the torque track segments 22. The connectors 64 of two adjacent torque track segments 22 may be coupled to one another with a knuckle 70 and one or more fasteners 72. For example, the knuckle 70 may be disposed at least partially within the connectors 64 and secured in place with the fasteners 72. In some embodiments, removing one or more of the fasteners 72 may enable the torque track segments 22 to pivot relative to one another and fold, such that sides 74 of adjacent torque track segments 22 may contact one another as shown in FIG. 3 (e.g., the torque track segments 22 are stacked on top of one another). However, an additional one or more of the fasteners 72 may continue to secure the knuckle 70 within the connectors 64. For example, a fastener 72 may provide a rotational axis 75 for the torque track segments 22 to rotate about, but maintain a physical connection between the torque track segments 22. Accordingly, the amount of time that may be spent re-assembling the torque track system 20 may be reduced.

FIG. 3 is a perspective view of a portion of the torque track system 20 in a partially stacked position 90 (e.g., partially folded position). For simplicity, the torque track system 20 shown in FIG. 3 includes three torque track segments 22. However, as noted above, the torque track system 20 may include any suitable number of torque track segments 22, such that the torque track system 20 provides sufficient support to the top drive 42 during drilling operations. As shown in the illustrated embodiment of FIG. 3, a first torque track segment 92 and a second torque track segment 94 are folded with respect to one another. For example, the first torque track segment 92 is positioned on top of the second torque track segment 94 (e.g., the first torque track segment 92 and the second torque tack segment 94 axially overlap with one another). To fold the first torque track segment 92 and the second torque track segment 94, two of the fasteners 72 may be removed from the rotatable joint 62 coupling the first torque track segment 92 and the second torque track segment 94, and two of the fasteners 72 may remain secured in the rotatable joint 62. For example, the rotatable joint 62 may include four openings 95 (e.g., two for the first torque track segment 92 and two for the second torque track segment 94) that extend through the connector 64 as well as two of the knuckles 70. Removing two of the fasteners 72 enables the knuckles 70 to rotate about the rotational axis 75 within the connectors 64 of the first and second torque track segments 92, 94, such that the first torque track segment 92 may ultimately be positioned on top of the second torque track segment 94 (or vice versa). The movement of the knuckles 70 within the connectors 64 is described in more detail herein with reference to FIGS. 8-10.

Additionally, FIG. 3 includes a third torque track segment 98 that is in an operating position 100 (e.g., operating configuration) with the second torque track segment 94. For example, the first end 66 of the second torque track segment 94 is generally axially aligned (e.g., flush) with the second end 68 of the third torque track segment 98. Accordingly, the second torque track segment 94 and the third torque track segment 98 both extend along a common axis 101. However, when assembling the torque track system 20 with respect to the drilling rig 10, the second torque track segment 94 and the third torque track segment 98 may extend in the direction 45 in which the top drive 42 is configured to move along the derrick 14 (e.g., FIG. 1). As shown in the illustrated embodiment of FIG. 3, four of the fasteners 72 (e.g., two in the second torque track segment 94 and two in the third torque track segment 98) extend through the connectors 64 and two of the knuckles 70 (not shown). Utilizing the four fasteners 72 may secure the second and third torque track segments 94, 98 in the operating position 100 (e.g., rotation of the knuckles 70 about the rotational axis 75 is blocked (e.g., resisted) by the additional fasteners 72 extending through the connectors 64 and knuckles 70 of the second and third torque track segments 94, 98). It should be noted that additional torque track segments 22 may be coupled to the first torque track segment 92 and/or the third torque track segment 98.

Figure 4:
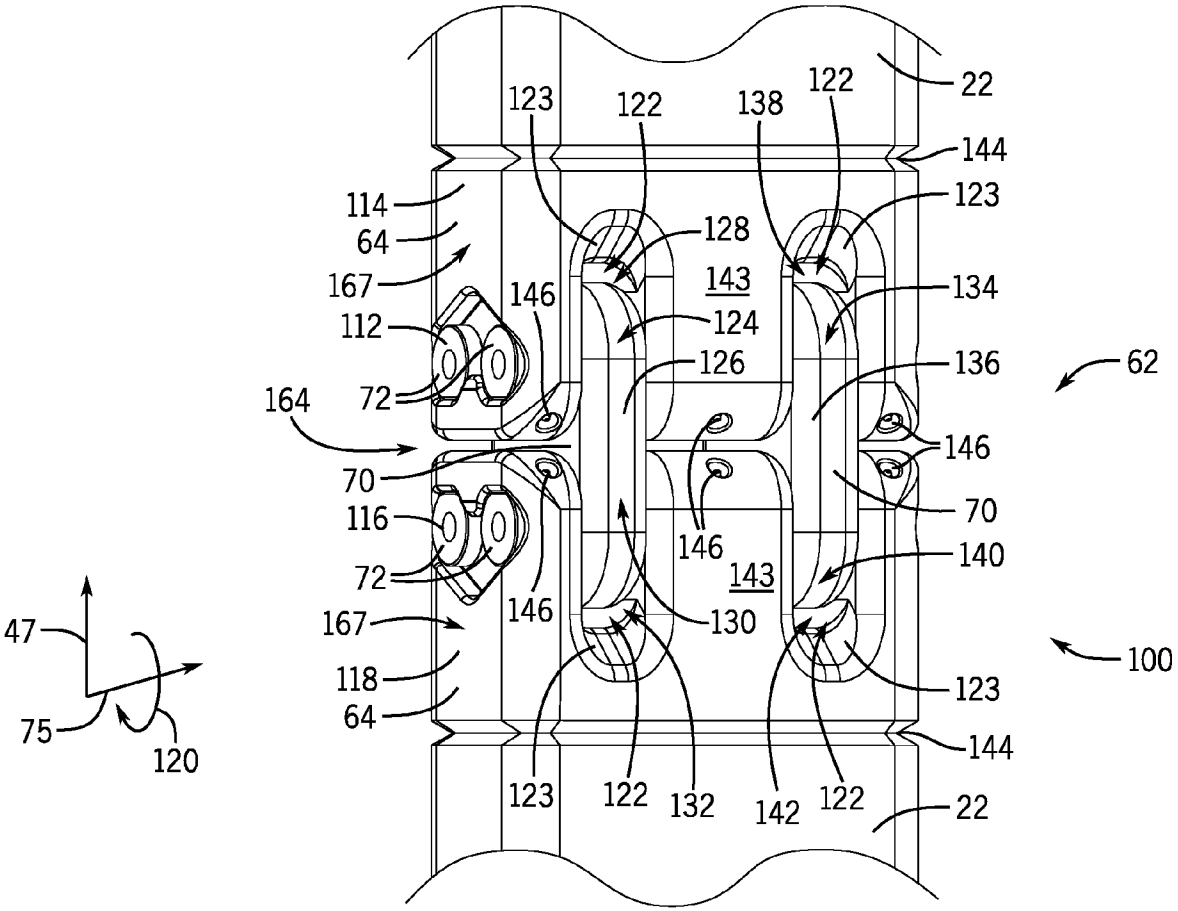
FIG. 4 is a perspective view of an embodiment of a rotatable joint of the torque track system of FIG. 1 when adjacent torque track segments are in an operating position, in accordance with an aspect of the present disclosure.

FIG. 4 is an expanded perspective view of the rotatable joint 62 when adjacent torque track segments 22 are in the operating position 100. As shown in the illustrated embodiment, two of the fasteners 72 extend through a respective connector 64 as well as two of the knuckles 70. It should be noted that, while the illustrated embodiment of FIG. 4 includes two of the knuckles 70 and four of the fasteners 72, any suitable number of such components may be included to establish a secure connection between the torque track segments 22 (e.g., such that the adjacent torque track segments 22 do not rotate about the rotational axis 75). When in the operating position 100, the torque track segments 22 are blocked from rotating about the rotational axis 75 and are secured in the operating position 100. However, in some embodiments, removing a first fastener 112 from a first connector 114 (and the knuckles 70) and removing a second fastener 116 from a second connector 118 (and the knuckles 70) enables the knuckles 70 to rotate within the first and second connectors 114 and 118 about the rotational axis 75, such that the adjacent torque track segments 22 pivot relative to one another and rotate in a circumferential direction 120 about the rotational axis 75 (see, e.g., FIGS. 8 and 9). As shown in the illustrated embodiment of FIG. 4, the first connector 114 and the second connector 118 are self-similar (e.g., generally the same shape and size as one another)

The first connector 114 and/or the second connector 118 may include grooves 122 configured to receive the knuckles 70. In certain embodiments, the grooves 122 may be recessed portions of the connectors 114, 118 configured to enable movement of the knuckles 70 in the circumferential direction 120. For example, the grooves 122 may include substantially rounded edges 123 to provide sufficient space for the knuckles 70 to rotate in the circumferential direction 120 without obstruction caused by sharp corners or edges. In certain embodiments, the rounded edges 123 conform or correspond to a position of the knuckles 70 when the torque track system 20 is in the stacked position 60 (see, e.g., FIG. 10). Accordingly, the knuckles 70 and/or the connectors 114, 118 do not block (e.g., resist) the torque track segments 22 from folding (e.g., stacking) completely onto one another.

As shown in the illustrated embodiment of FIG. 4, when the torque track system 20 is in the operating position 100, a first portion 124 of a first knuckle 126 may be disposed in a first groove 128 of the first connector 114. Similarly, a second portion 130 of the first knuckle 126 may be disposed in a first groove 132 of the second connector 118. The fasteners 72 may extend through the openings 95 extending through the first connector 114, the second connector 118, and the first knuckle 126, such that the first knuckle 126 secures the adjacent torque track segments 22 to one another and blocks (e.g., resists) the first knuckle 126 from rotating in the circumferential direction 120. Similarly, a first portion 134 of a second knuckle 136 may be disposed in a second groove 138 of the first connector 114, and a second portion 140 of the second knuckle 136 may be disposed in a second groove 142 of the second connector 118. The fasteners 72 may extend through additional openings 95 extending through the first connector 114, the second connector 118, and the second knuckle 136, such that the second knuckle 136 secures the adjacent torque track segments 22 to one another and blocks (e.g., resists) the second knuckle 136 from rotating in the circumferential direction 120. When the torque track system 20 is in the operating position 100, the first and second knuckles 126, 136 may completely fit (e.g., laterally) within the first and second grooves 132, 138, respectively (e.g., the knuckles 126, 136 are substantially flush with an outer surface 143 of the connectors 64 and do not protrude beyond the grooves 132, 138).

In some embodiments, the connectors 64 may be coupled to the torque track segments 22 via a weld or other connection forming a V-groove 144 between the respective connectors 64 and torque track segments 22. Additionally, the connectors 64 may include grease nipples 146 (e.g., openings) that are configured to supply grease to the connectors 64 to facilitate movement of the knuckles 70.

Figure 5:
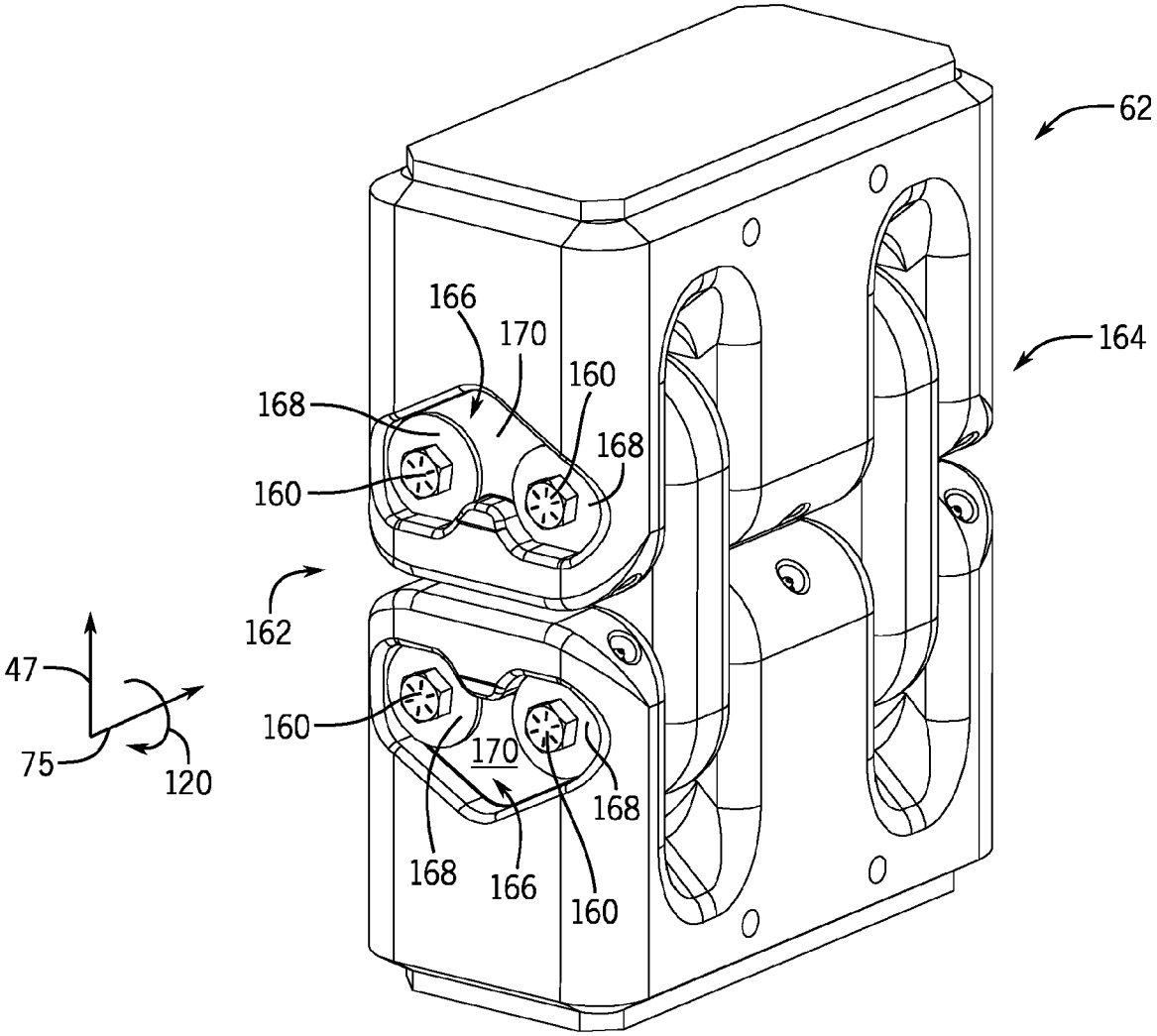
FIG. 5 is a perspective view of another end of the rotatable joint of FIG. 4, in accordance with an aspect of the present disclosure.

In some embodiments, the fasteners 72 are further secured in the openings 95 via threaded bolts 160, as shown in FIG. 5. For example, FIG. 5 is a perspective view of an opposite end 162 of the rotatable joint 62 from an end 164 of the rotatable joint 62 illustrated in FIG. 4. The fasteners 72 may extend from the end 164 toward the opposite end 162. However, in some embodiments, the fasteners 72 may not protrude from indentations 166 on the opposite end 162 (e.g., the fasteners 72 to do not extend beyond an outer surface 167 of the connectors 64). Accordingly, the threaded bolts 160 may extend through the indentations 166 toward the fasteners 72. For example, the fasteners 72 may include threaded openings (not shown) configured to receive the threaded bolts 160. Accordingly, the fasteners 72 may be secured within the openings 95 extending through the connectors 64 and the knuckles 70, such that the adjacent torque track segments 22 are blocked from rotating in the circumferential direction 120.

In some embodiments, a washer 168 may be included between the threaded bolts 160 and a surface 170 in the indentations 166 of the connectors 64. The washer 168 may be configured to lock the threaded bolts 160 into place, thereby securing the threaded bolts 160 in the openings 95. Additionally, as shown in the illustrated embodiments of FIG. 5, the indentations 166 on the ends 162 and/or 164 of the rotatable joint 62 may be substantially heart-shaped (or C-shaped). The heart-shaped (or C-shaped) configuration of the indentations 166 may facilitate access to the threaded bolts 160 and/or the fasteners 72, such that the time for manipulating the torque track system 20 may be reduced. For example, the heart-shaped (or C-shaped) configuration of the indentations 166 may conform to a shape of a tool utilized by a technician to tighten and/or loosen the threaded bolts 160 from the fasteners 72. Additionally, the heart-shaped (or C-shaped) configuration may facilitate movement of the tool when tightening and/or loosening the threaded bolts 160 (e.g., the heart-shaped configuration (or C-shaped) does not block (e.g., resist) movement of the tool when manipulating the torque track system 20). Further, the heart-shaped (or C-shaped) configuration may enable an operator to utilize a crow bar or other mechanical tool to remove the threaded bolts 160 when the threaded bolts 160 cannot be loosened using a wrench, for example.

Figure 6:
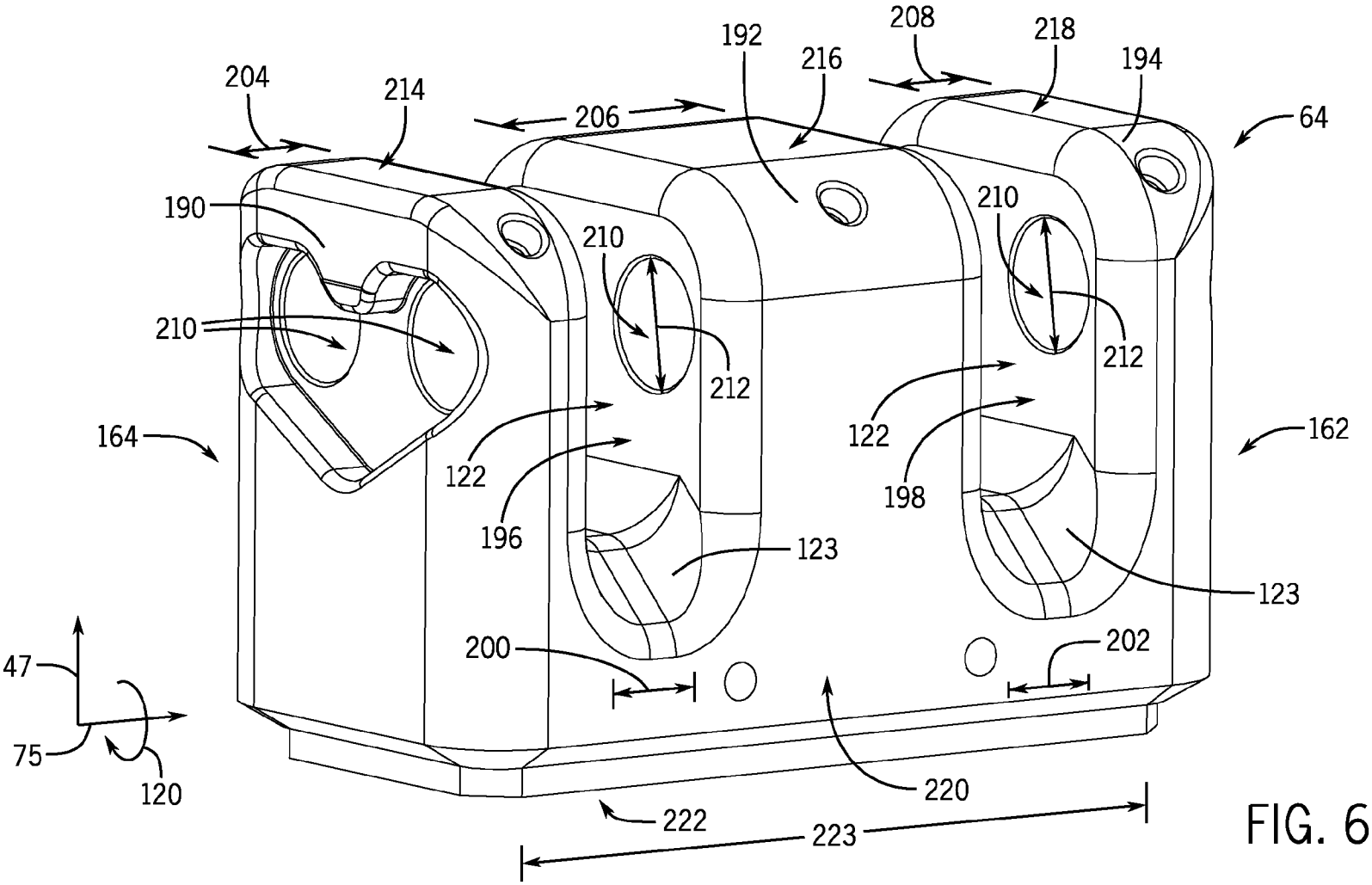
FIG. 6 is a perspective view of an embodiment of a connector of the torque track system of FIG. 1, in accordance with an aspect of the present disclosure.

FIG. 6 is a perspective view of a connector 64 that may be used in embodiments of the torque track system 20. As shown in the illustrated embodiment of FIG. 6, the connector 64 includes two of the grooves 122 (e.g., recessed portions of the connector 64) that are configured to receive the knuckles 70 and enable rotation of the knuckles 70 in the circumferential direction 120 about the rotational axis 75, such that the torque track segments 22 may reach the stacked configuration 60 (e.g., folded configuration). As discussed above, the grooves 122 may include the substantially rounded edges 123 that provide the knuckles 70 with sufficient space to rotate, and thus, for adjacent torque track segments 22 to contact one another in the stacked configuration 60 (e.g., folded configuration).

In some embodiments, the connector 64 may have a first segment 190, a second segment 192, and/or a third segment 194, where the segments 190, 192, and 194 are separated by the grooves 122. For example, a first groove 196 (e.g., first recess) may be formed between the first segment 190 and the second segment 192, and a second groove 198 (e.g., second recess) may be formed between the second segment 192 and the third segment 194. The first groove 196 may include a first width 200 and the second groove 198 may include a second width 202. In some embodiments, the first width 200 and the second width 202 may be generally equal, such that the knuckles 70 may be uniformly manufactured to fit the first and second widths 200, 202. In other embodiments, the first and second widths 200, 202 may be different from one another (e.g., to accommodate manufacturing tolerances in the knuckles 70).

Additionally, the first segment 190 may include a first thickness 204, the second segment 192 may include a second thickness 206, and the third segment 194 may include a third thickness 208. In some embodiments, the second thickness 206 may be greater than the first thickness 204 and/or the third thickness 208. Additionally, the first thickness 204 and the third thickness 208 may be generally equal (e.g., within 5% of one another). In other embodiments, the first thickness 204, the second thickness 206, and the third thickness 208 may be any suitable thicknesses, such that, when combined with the widths 200, 202, the fasteners 72 may extend through a sufficient length of the connector 64 to couple with the threaded bolts 160.

In order for the fasteners 72 to extend through the connectors 64, the first segment 190, the second segment 192, and the third segment 194 may each include one or more openings 210 that enable the fasteners 72 to extend from the end 164 of the rotatable joint 62 to the opposite end 162. Each of the openings 210 may include a diameter 212 that is sufficient in size to allow the fasteners 72 to pass through the openings 210 (e.g., the diameter 212 of each of the openings 210 may be generally equal or different so long as the diameter 212 adequately accommodates the fasteners 72).

The first segment 190 may include a first surface 214, the second segment 192 may include a second surface 216, and the third segment 194 may include a third surface 218. In certain embodiments, the first surface 214, the second surface 216, and/or the third surface 218 may be substantially flat (e.g., no bumps and/or curved portions) such that the connector 64 may be flush with an adjacent connector 64 when in the operating position 100 (e.g., FIGS. 4 and 5). The first segment 190, the second segment 192, the third segment 194, the first groove 196, and the second groove 198 may converge at a bottom 220 of the connector 64 to form a surface 222 that couples to the torque track segment 22. Accordingly, each of the various segments 190, 192, and 194 of the connector 64 may be arranged to couple to the torque track segment 22 at generally the same time. In some embodiments, the surface 222 may include a length 223 that is generally equal to a length of the ends 66, 68 of the torque track segments 22, such that the connector 64 is flush with the torque track segments 22.

Figure 7:
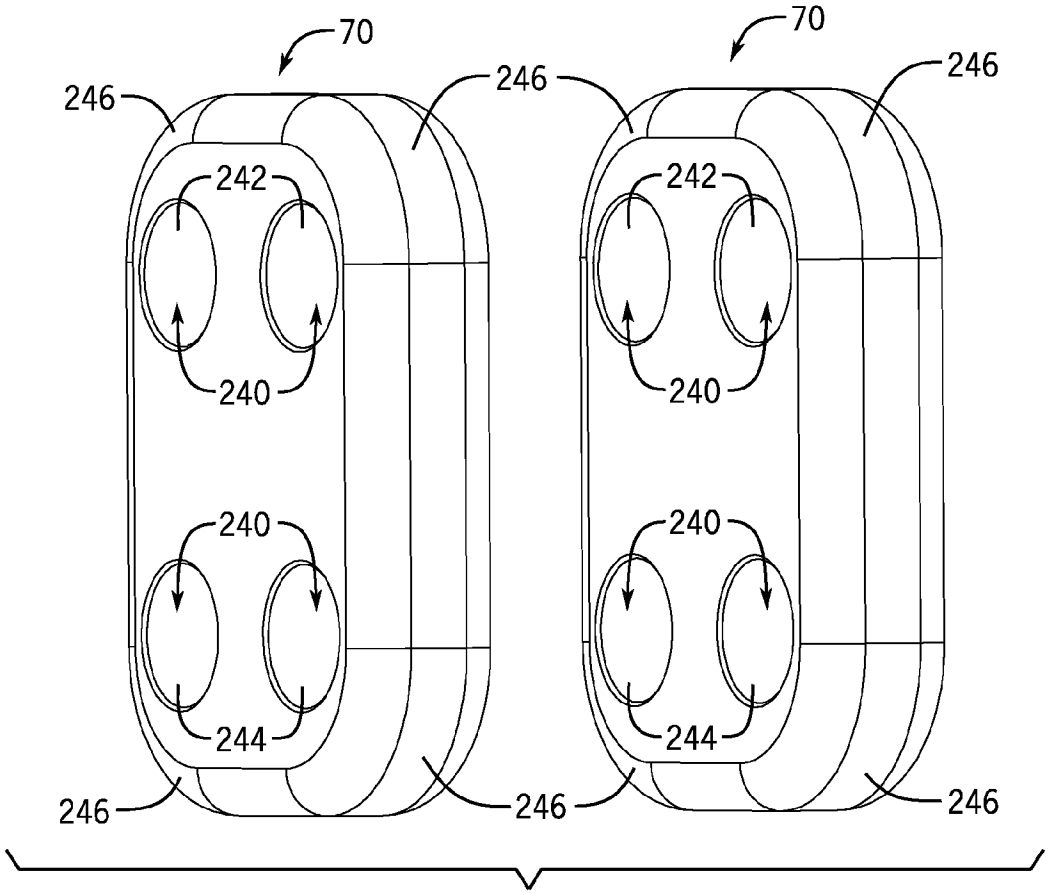
FIG. 7 is a perspective view of an embodiment of knuckles utilized to couple adjacent torque track segments to one another, in accordance with an aspect of the present disclosure.

As discussed above, the knuckles 70 may be coupled to the connectors 64 (e.g., the first segment 190, the second segment 192, and/or the third segment 194) by extending the fasteners 72 through corresponding openings 240 of the knuckles 70, which are shown in FIG. 7. For example, FIG. 7 is a perspective view of an embodiment of the knuckles 70 (e.g., two of the knuckles 70) that may be utilized to couple adjacent torque track segments 22 to one another. For example, the openings 240 of the knuckles 70 may generally align with the openings 210 of the connectors 64. Accordingly, the openings 210 of the segments 190, 192, and 194 in combination with the openings 240 form the openings 95 of the rotatable joint 62. As discussed above, the fasteners 72 may extend through the openings 95 of the rotatable joint 62 (e.g., both the connector 64 and the knuckles 70) to secure the knuckles 70 to the connector 64.

As shown in the illustrated embodiment of FIG. 7, each of the knuckles 70 includes four openings 240. Two openings 242 of the four openings 240 may couple the knuckle 70 to the first connector 114 and the remaining two openings 244 of the four openings 240 may couple the knuckle 70 to the second connector 118, for example. The knuckles 70 may be generally rectangular shaped and include rounded corners 246 that may facilitate movement (e.g., rotation) of the knuckles 70 within the grooves 122 from the operating position 100 to the stacked position 60 (e.g., when one or more of the fasteners 72 are removed). For example, sharp corners and/or pointed corners may obstruct movement (e.g., rotation) of the knuckles 70 by contacting a surface of the grooves 122 and/or other surfaces of the connectors 64, which may block (e.g., resist) movement of the knuckles 70. The rounded corners 246 of the knuckles 70 in combination with the rounded edges 123 of the grooves 122 may facilitate movement (e.g., rotation) of the knuckles 70 within the connectors 64, such that the torque track segments 22 may move and pivot from the operating position 100 to the stacked position 60 (or vice versa) without obstruction. In other embodiments, the knuckles 70 may include any suitable shape that enables a secure connection to the connectors 64, as well as facilitates movement of the knuckles 70 within the grooves 122 (e.g., when one or more of the fasteners 72 are removed). For example, the knuckles 70 may be oval shaped, square shaped, circular, parallelogram shaped, or any other suitable shape.

Figure 8:
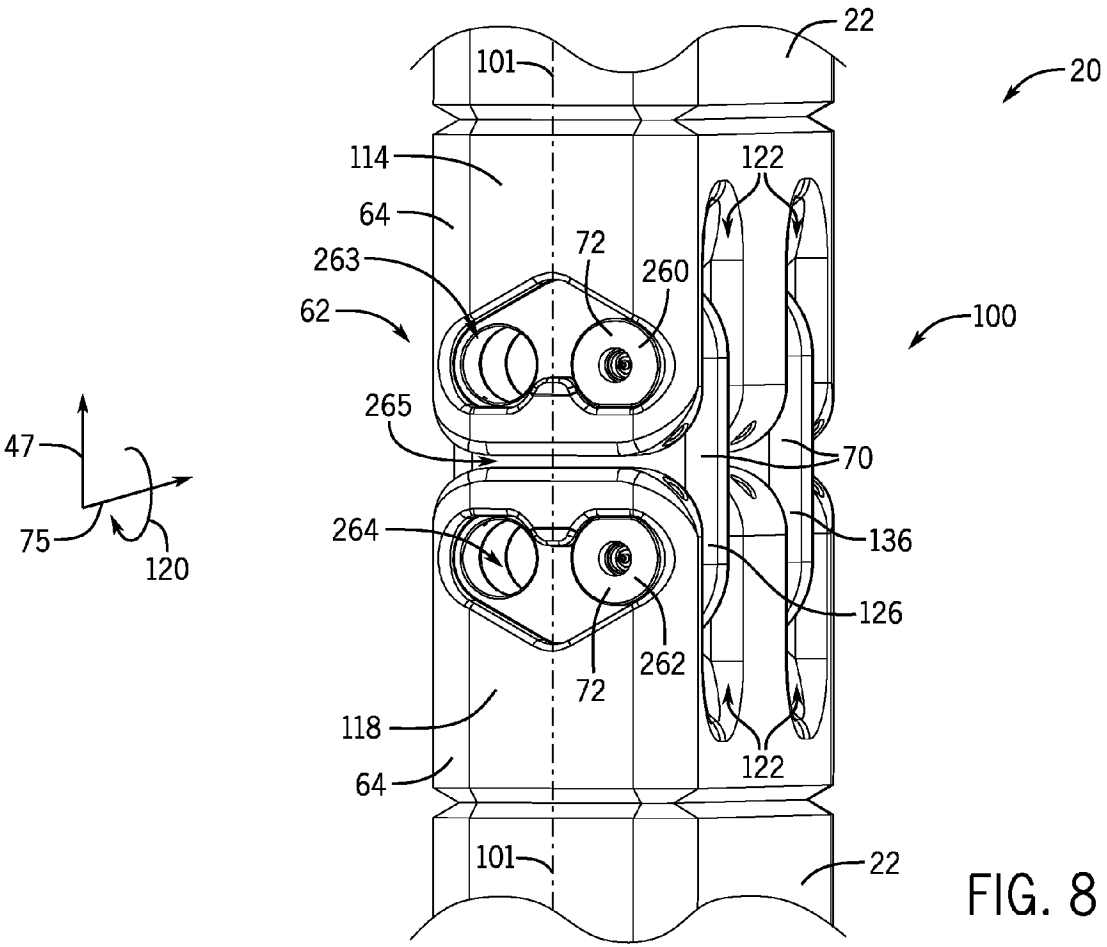
FIG. 8 is a perspective view of an embodiment of the rotatable joint of FIGS. 4 and 5 when the torque track system is in the operating position with one or more fasteners removed from the rotatable joint, in accordance with an aspect of the present disclosure.

As discussed above, the knuckles 70 enable the torque track system 20 to move from the operating position 100 to the stacked position 60, while maintaining a connection between adjacent torque track segments 22 (e.g., one or more of the fasteners 72 remain in the rotatable joints 62 and enable rotation about the rotational axis 75). For example, FIG. 8 is a perspective view of the rotatable joint 62 when the torque track system 20 is in the operating position 100. As shown in the illustrated embodiments, a first fastener 260 extends through the first connector 114, the first knuckle 126, and the second knuckle 136, and a second fastener 262 extends through the second connector 118, the first knuckle 126, and the second knuckle 136. However, other fasteners 72 have been removed from a first opening 263 and a second opening 264, thereby enabling the knuckles 126 and 136 to rotate (e.g., in a clockwise direction) within the grooves 122 of the first and second connectors 114, 118.

As shown in the illustrated embodiment, the first and second fasteners 260, 262, as well as the first and second openings 263, 264, are generally aligned with one another with respect to the common axis 101. Therefore, the knuckles 126 and 136 are free to rotate in the circumferential direction 120 (e.g., a clockwise direction) about the axis 75 because a portion 265 of the knuckles 126 and 136 are no longer secured to the connectors 64, thereby enabling movement within the grooves 122. However, removing fasteners 72 from the rotatable joint 62 that are not generally aligned along the common axis 101 (e.g., fasteners 72 positioned diagonally with respect to one another) may not enable movement of the torque track segments 22 in the circumferential direction 120 because the portion 265 of the knuckles 126 and 136 may remain secured to one or more of the connectors 64.

Further, it should be noted that the knuckles 126 and 136 may rotate in a circumferential direction opposite to the circumferential direction 120 (e.g., a counter-clockwise direction) when fasteners 72 are disposed in the first opening 263 and the second opening 264 and the first fastener 260 and the second fastener 262 are removed. For example, the knuckles 126 and 136 (and thus the adjacent torque track segments 22) may form a generally 0 degree angle (e.g., within 5%) with respect to one another when in the stacked position 60 (e.g., a first stacked position). Accordingly, the knuckles 126 and 136 (and the adjacent torque track segments 22) may be configured to rotate between 150 and 200 degrees in the first circumferential direction 120 to reach the operating position 100 (e.g., when the first and second fasteners 260, 262 extend through the knuckles 126 and 136). In some embodiments, the knuckles 126 and 136 (and the adjacent torque track segments 22) may form a generally 180 degree angle (e.g., within 5%) with respect to one another when in the operating position. Additionally, the knuckles 126 and 136 (and the adjacent torque track segments 22) may rotate in the circumferential direction opposite the circumferential direction 120 when the first and second fasteners 260 and 262 are removed. Therefore, the knuckles 126 and 136 (and the adjacent torque track segments 22) may rotate between 150 and 200 degrees in the circumferential direction opposite the circumferential direction 120 to the stacked position 60 (e.g., a second stacked position). Accordingly, the knuckles 126 and 136 (and the adjacent torque track segments) may be configured to rotate between 200 and 350 degrees, between 250 and 310 degrees, or between 275 and 300 degrees from a first stacked position, to the operating position 100, and to a second stacked position.

Additionally, in certain embodiments, when adjusting adjacent torque track segments 22 from the stacked position 60 to the operating position 100, the connectors 64 may be configured to facilitate alignment of the openings 95. For example, a first torque track segment 22 may be disposed against a V-door of the drilling rig 10 and the second connector 118 may be secured to both the first and second knuckles 126 and 136 via the second fastener 262 and a third fastener disposed through the second opening 264. Additionally, the first fastener 260 may extend through the first connector 114. Accordingly, as the adjacent torque track segments 22 are rotated with respect to one another, the first and second connectors 114, 118 may contact one another upon reaching the operating position 100, thereby blocking further rotation of the adjacent torque track segments. Additionally, upon reaching the operating position, the first opening 263 may be substantially aligned (e.g., openings of the first connector 114 and the knuckles 126 and 136 are coaxially aligned). For example, chamfers of the knuckles 126 and 136, the connector 114, and/or the fourth fastener may be aligned to facilitate thereby facilitating disposal of a fourth fastener into the opening 236 (e.g., hammering the fourth fastener into the opening 236). When the fourth fastener is disposed in the first opening 263, the adjacent torque track segments 22 may be secured in the operating position 100.

Figure 9:
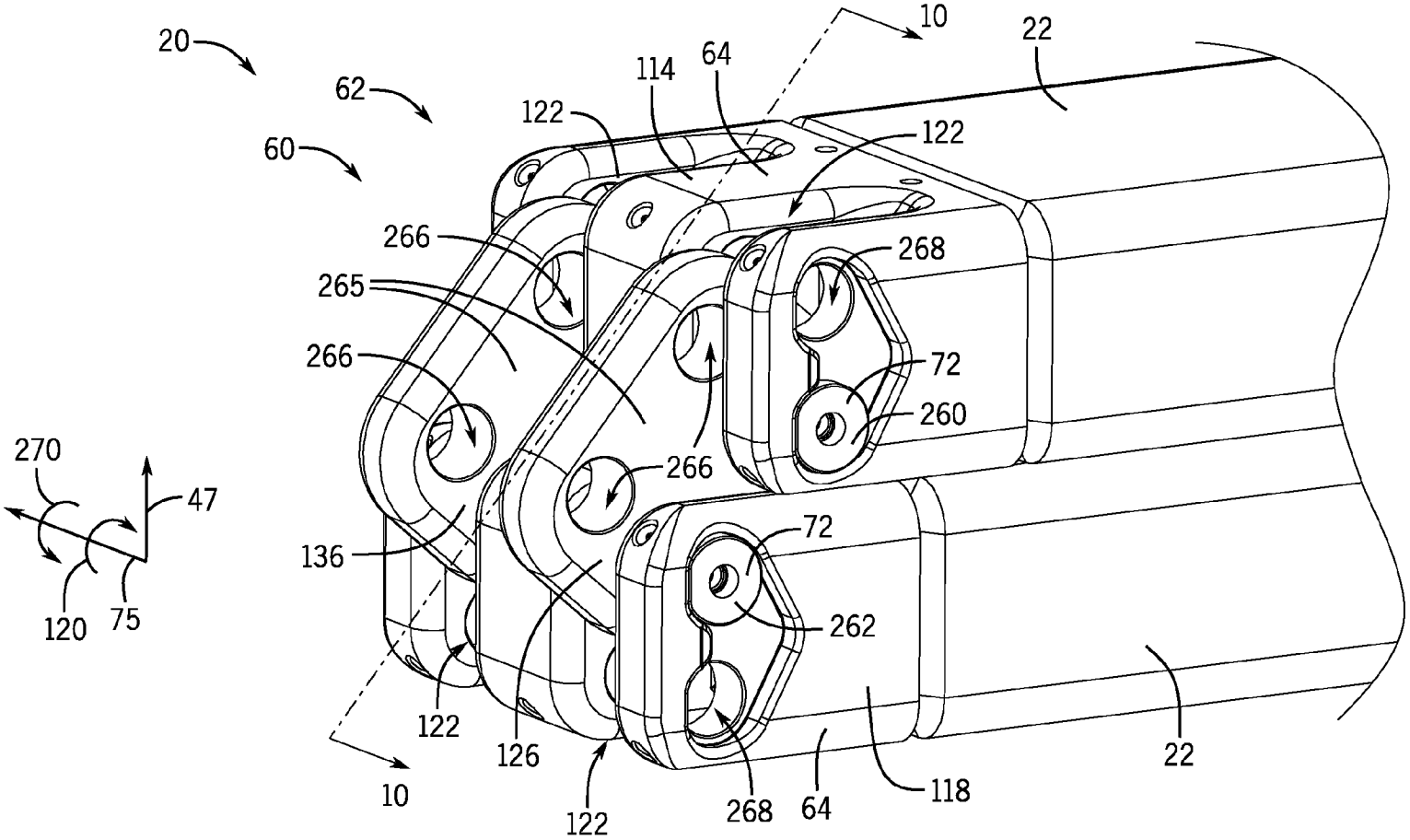
FIG. 9 is a perspective view of an embodiment of the rotatable joint of FIG. 8 when the torque track system is in the stacked position, in accordance with an aspect of the present disclosure.

FIG. 9 is a perspective view of the rotatable joint 62 when the torque track system 20 is in the stacked position 60. When in the stacked position 60, the knuckles 126, 136 may protrude from the grooves 122 when compared to a position of the knuckles 126, 136 in the operating position 100 (e.g., FIG. 8). As shown in the illustrated embodiment of FIG. 9, the knuckles 126, 136 have rotated in the circumferential direction 120 about the rotational axis 75, thereby causing the adjacent torque track segments 22 to pivot and fold over onto one another (e.g., stack one on top of the other while maintaining a physical connection). However, the adjacent torque track segments 22 remain coupled to one another via the knuckles 126, 136 and the fasteners 260, 262, which may facilitate improved and more efficient re-assembly of the torque track system 20.

As shown in the illustrated embodiment of FIG. 9, openings 266 of the knuckles 70 are no longer aligned with openings 268 of the connectors 64, where the openings 266 and the openings 268 correspond to the openings 263, 264 of the rotatable joint 62 in which the fasteners 72 were removed. When re-assembling the torque track system 20 (e.g., moving into the operating position 100), the torque track segments 22 may be rotated in a second circumferential direction 270 to realign the openings 266 of the knuckles 70 and the openings 268 of the connectors 64 (e.g., to form the openings 263, 264), such that fasteners 72 may extend through the first and second openings 263, 264 and secure the torque track system 20 in the operation position 100.

Figure 10:
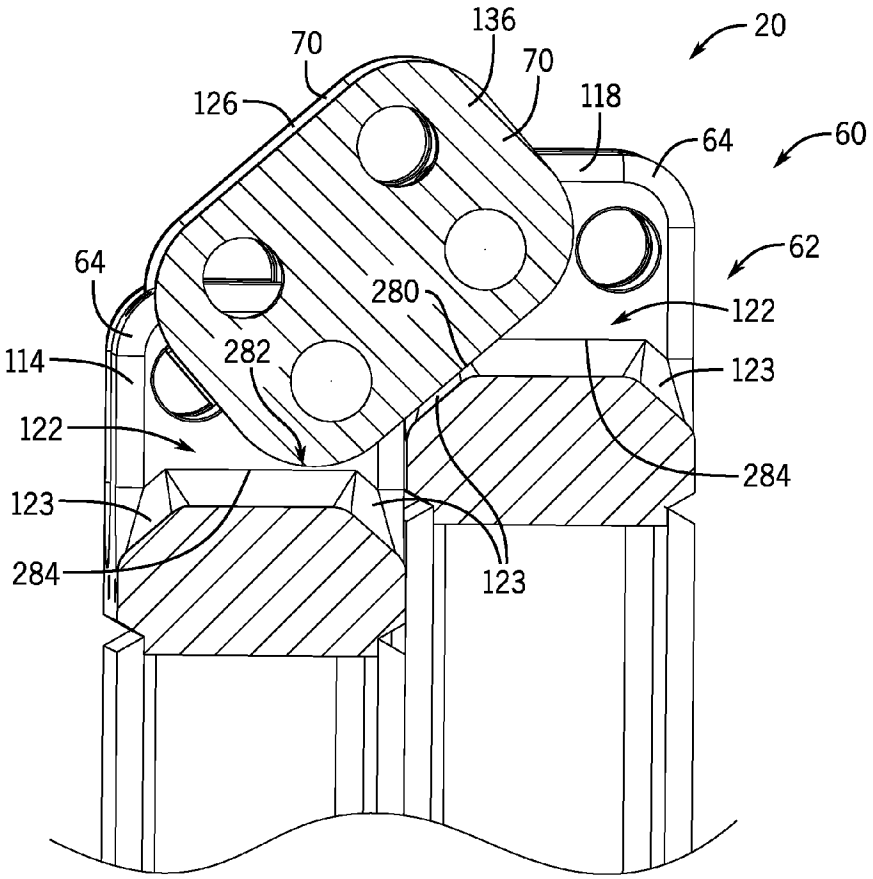
FIG. 10 is a sectional view of the rotatable joint of FIG. 9, in accordance with an aspect of the present disclosure.

As discussed above, the grooves 122 of the connectors 64 may include the rounded edges 123 to provide sufficient space for the knuckles 126, 136 to rotate, and thus, for the adjacent torque track segments 22 to completely fold over onto one another. Accordingly, the torque track system 20 may be relatively compact in the stacked position 60 to facilitate transportation of the torque track system 20. For example, FIG. 10 is a sectional view of the rotatable joint 62 in the stacked position 60. As shown in the illustrated embodiment of FIG. 10, the knuckles 126, 136 may include an edge 280 that contacts the rounded edges 123 of one or both of the connectors 114 and/or 118. In some embodiments, contact between the knuckles 126, 136 and the rounded edges 123 may absorb the weight of the torque track segment 22 positioned above (e.g., with respect to a ground 16 or the Earth) an adjacent torque track segment 22, thereby blocking damage (e.g., compression damage) to torque track segments 22 positioned closer to the ground 16 (e.g., the Earth). In other embodiments, contact between adjacent torque track segments 22 occurs before contact between the edge 280 and the rounded edges 123, such that the edge 280 and the rounded edges 123 do not contact one another in the stacked position 60.

Additionally, the embodiment of FIG. 10 shows that a corner 282 of the knuckles 126 and/or 136 may be positioned proximate to a surface 284 of one of the grooves 122. As discussed above, the corner(s) 282 of the knuckles 126, 136 may be generally rounded to facilitate translation of the knuckles 126, 136 within the grooves 122, such that the knuckles 126, 136 rotate within the grooves 122 without obstruction.

Figure 11:
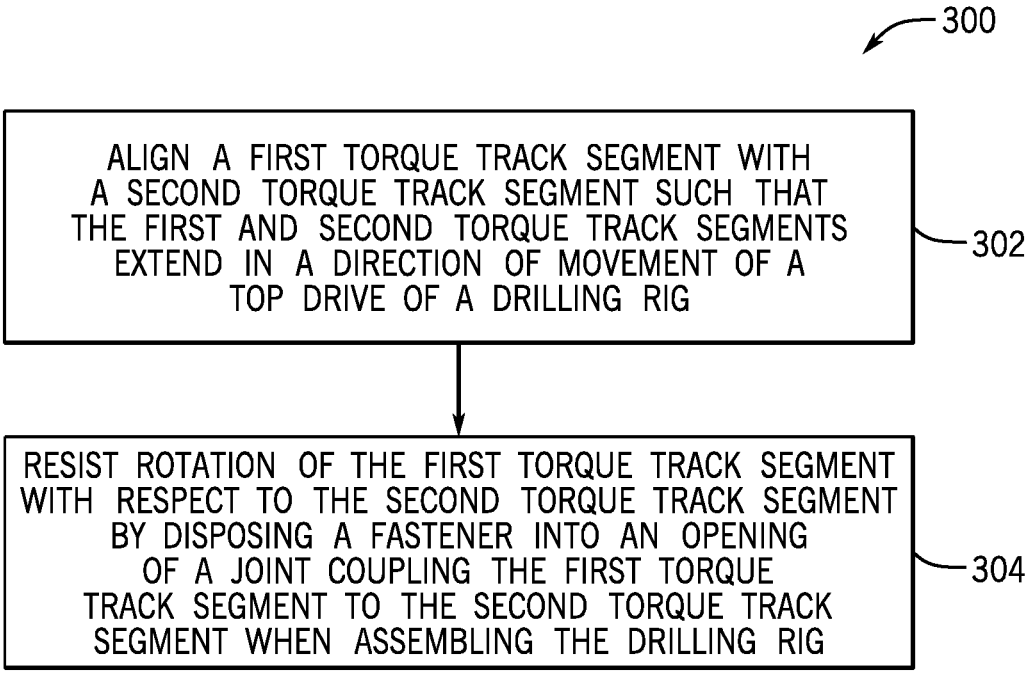
FIG. 11 is a flow diagram of an embodiment of a process for assembling the torque track assembly of FIG. 1, in accordance with an aspect of the present disclosure.

As discussed above, embodiments of the present disclosure may facilitate manipulating the drilling rig 10 by reducing an amount of time for assembling and/or disassembling the torque track system 20. For example, FIG. 11 is a block diagram of an embodiment of a process 300 for assembling the torque track system 20. For example, at block 302, the first torque track segment 92 and the second torque track segment 94 may be aligned with one another along the common axis 101 (e.g., rotating the first torque track segment 92 with respect to the second torque track segment 94 such that the openings 210 of the connectors 114, 118 are generally aligned with the openings 240 of the knuckles 70). Accordingly, the first torque track segment 92 and the second torque track segment 94 may be axially aligned along the vertical axis 47, such that the torque track system 20 may be coupled to the derrick 14, and ultimately, coupled to the top drive 42. In some embodiments, the vertical axis 47 may be generally parallel (e.g., within 0 and 25 degrees, within 1 and 10 degrees, or within 2 and 5 degrees) to the direction 45 in which the top drive 42 moves along the derrick 14.

Additionally, once the first torque track segment 92 and the second torque track segment 94 are aligned with one another (e.g., the openings 210 are aligned with the openings 240), the torque track segments 22 may be secured to one another to block adjacent torque track segments 22 from rotating or pivoting relative to one another. For example, at block 304, rotation of the first torque track segment 92 with respect to the second torque track segment 94 may be blocked (e.g., resisted) by disposing the fastener 72 into the openings 210 of the connectors 114, 118 and through the openings 240 of the knuckles 70 (e.g., the openings 95 of the rotatable joint 62). Accordingly, the torque track system 20 may remain substantially stationary with respect to the derrick 14 during drilling operations and thereby block (e.g., resist) lateral movement of the top drive 42 and absorb torsional loads from drilling operations. Additionally, the torque track system 20 may transfer torsional loads incurred during drilling operations to the derrick 14, thereby reducing wear on the top drive 42.

Similarly, when disassembly of the drilling rig 10 is desired, one or more of the fasteners 72 may be removed from the rotatable joints 62 to enable rotation of the first torque track segment 92 with respect to the second torque track segment 94 to place the torque track system 20 into the stacked position 60. It should be noted, however, that at least one of the fasteners 72 remains in each of the connectors 114 and 118, such that the first torque track segment 92 and the second torque track segment 94 remain connected to one another in the stacked position 60. Accordingly, the time for re-assembly of the torque track system 20 may be reduced because each of the torque track segments 22 may be partially coupled to one another.

Embodiments of the present disclosure relate to a torque track system 20 that may be adjusted from an operating position 100 to a stacked position 60 (or vice versa), while maintaining a connection between adjacent torque track segments 22. Such a system may facilitate improved manipulation (e.g., assembly and/or disassembly) of the torque track system 20 because the torque track segments 22 are partially coupled to one another in the stacked position 60, thereby reducing an amount of time to perform manipulation. Additionally, transportation of the torque track system 20 may be improved because of the relatively compact configuration of the torque track system 20 when in the stacked position 60.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. A system, comprising:

a torque track system configured to couple to a derrick and to a top drive of a drilling rig, wherein the torque track system is configured to resist movement of the top drive in a lateral direction with respect to the derrick and to transfer torsional loads to the derrick in an operating configuration;

a first torque track segment of the torque track system;

a second torque track segment of the torque track system; and a joint coupling the first torque track segment to the second torque track segment, wherein the joint comprises:

a knuckle configured to enable the first torque track segment and the second torque track segment to pivot with respect to one another while maintaining a physical connection between the first torque track segment and the second torque track segment during manipulation of the torque track system into and out of the operating configuration;

a first connector coupled to a first end of the first torque track segment;

a first opening formed when the knuckle is disposed in a first groove of the first connector, wherein the first opening extends through the first connector and the knuckle;

a second opening formed when the knuckle is disposed in the first groove of the first connector, wherein the second opening extends through the first connector and the knuckle;

a first fastener configured to be disposed in the first opening; and a second fastener configured to be disposed in the second opening, wherein:

each of the first and second fasteners is configured to enable rotation of the first torque track segment with respect to the second torque track segment when the other of the first and second fasteners is not disposed in the first or second opening, respectively, and the first and second fasteners are configured to substantially block rotation of the first torque track segment with respect to the second torque track segment when the first and second fasteners are disposed in the first and second openings, respectively.

2. The system of claim 1, wherein the joint comprises a second connector coupled to a second end of the second torque track segment, and wherein the first connector and the second connector are self-similar.

3. The system of claim 2, wherein the knuckle is secured to the first and second connectors with the first fastener and a third fastener, respectively, wherein the third fastener is disposed in a third opening formed when the knuckle is disposed in a second groove of the second connector, wherein the third opening extends through the second connector and the knuckle, and wherein the third fastener is configured to enable rotation of the second torque track segment with respect to the first torque track segment.

4. The system of claim 3, wherein a fourth fastener extends through a fourth opening formed when the knuckle is disposed in the second groove of the second connector when the torque track system is in an operating position, wherein the fourth opening extends through the second connector and the knuckle.

5. The system of claim 4, wherein the first, second, third, and fourth fasteners are secured within the first, second, third, and fourth openings via securement features.

6. The system of claim 3, wherein the first fastener is disposed in the first opening, the third fastener is disposed in the third opening, the second fastener is not disposed in the second opening, and a fourth fastener is not disposed in a fourth opening during disassembly of the torque track system, wherein the fourth opening extends through the second connector and the knuckle and is formed when the knuckle is disposed in the second groove of the second connector.

7. The system of claim 6, wherein the knuckle is configured to pivot within the first groove and the second groove to pivot the first torque track segment with respect to the second torque track segment, such that the torque track system moves from the operating configuration to a stacked configuration.

8. The system of claim 7, wherein the first groove and the second groove each comprise rounded edges configured to facilitate movement of the knuckle within the first groove and the second groove.

9. The system of claim 3, wherein the first fastener and the third fastener are generally aligned with one another with respect to a vertical axis extending along a length of the torque track system when the torque track system is in the operating configuration.

10. A torque track system, comprising:

a plurality of torque track segments, wherein a first end torque track segment of the plurality of torque track segments is configured to couple the torque track system to a first end of a drilling rig, and wherein a second end torque track segment of the plurality of torque track segments is configured to couple the torque track system to a second end of the drilling rig; and a plurality of joints configured to couple the plurality of torque track segments to one another, wherein each joint of the plurality of joints comprises a first connector and a knuckle secured to the first connector by a first fastener and a second fastener of a plurality of fasteners, wherein each of the first and second fasteners is configured to enable the knuckle to rotate within grooves of the first connector such that each torque track segment of the plurality of torque track segments pivots relative to one another from an operating configuration to a stacked configuration when the other of the first and second fasteners is not coupled with the knuckle, and wherein the first and second fasteners are configured to substantially block rotation of each torque track segment of the plurality of torque track segments when the first and second fasteners are coupled with the knuckle, such that each torque track segment does not pivot relative to one another in the operating configuration.

11. The torque track system of claim 10, wherein the plurality of torque track segments is configured to resist lateral movement of a top drive of the drilling rig and to transfer torsional loads caused by drilling operations to a derrick of the drilling rig when in the operating configuration.

12. The torque track system of claim 10, wherein a first torque track segment of the plurality of torque track segments and a second torque track segment of the plurality of torque track segments substantially axially overlap with one another with respect to a longitudinal axis along a length of the first torque track segment when in the stacked configuration, and wherein the first torque track segment of the plurality of torque track segments and the second torque track segment of the plurality of torque track segments remain physically coupled to one another in the stacked configuration.

13. A method, comprising:

aligning a first torque track segment with a second torque track segment, such that the first and second torque track segments extend in a direction of movement of a top drive of a drilling rig;

resisting rotation of the first torque track segment with respect to the second torque track segment by disposing a first fastener into a first opening and a second fastener into a second opening of a joint coupling the first torque track segment to the second torque track segment when assembling the drilling rig, wherein the first and second openings are formed through a knuckle and a first connector of the joint, wherein the first connector is coupled to a first end of the first torque track segment, and wherein the knuckle is disposed in a groove of the first connector; and selecting for removal either the first fastener from the first opening or the second fastener from the second opening;

removing the selected fastener; and moving the first and second torque track segments with respect to one another about the pivot axis of the non-selected fastener, wherein the first and second fasteners are configured to substantially block rotation of the first torque track segment with respect to the second torque track segment when the first and second fasteners are disposed in the first and second openings, respectively.

14. The method of claim 13, comprising:

removing the second fastener from the second opening of the joint coupling the first torque track segment to the second torque track segment to enable rotation of the first torque track segment with respect to the second torque track; and folding the first torque track segment onto the second torque track segment while maintaining a connection between the first torque track segment and the second torque track segment with a third fastener extending through the knuckle and a second connector of the joint, wherein the second connector is coupled to a second end of the second torque track segment.

15. The method of claim 13, wherein aligning the first torque track segment with the second torque track segment comprises rotating the first torque track segment with respect to the second torque track segment, such that the first and second openings of the joint extend through the first connector and the knuckle of the joint.

16. The method of claim 15, wherein resisting rotation of the first torque track segment with respect to the second torque track segment comprises disposing a third fastener through a third opening extending through a second connector and the knuckle of the joint to resist rotation of the knuckle within the second connector.

* * * * *